US005836674A

United States Patent [19]

Nishitani et al.

[11] Patent Number: 5,836,674

[45] Date of Patent: Nov. 17, 1998

[54] LENS STRUCTURE FOR LAMPS

[75] Inventors: Norihiro Nishitani; Hirokazu Yanagihara; Masamitsu Wada, all of Shizuoka, Japan

[73] Assignee: Koito Manufacturing Co., Ltd., Tokyo, Japan

[21] Appl. No.: 614,698

[22] Filed: Mar. 13, 1996

[30] Foreign Application Priority Data

Mar. 18, 1995 [JP] Japan ..... 7-086254

[51] Int. Cl.[6] ..... F21V 5/00

[52] U.S. Cl. ..... 362/336; 362/244; 362/309; 362/332

[58] Field of Search ..... 362/242, 244, 362/246, 308, 309, 331, 332, 336, 338

[56] References Cited

U.S. PATENT DOCUMENTS 1,322,776 11/1919 Foster et al. ..... 362/336

FOREIGN PATENT DOCUMENTS 3840313 5/1990 Germany ..... 362/309

2278669 12/1994 United Kingdom ..... 362/309

*Primary Examiner*—Stephen F. Husar

*Attorney, Agent, or Firm*—Sughrue, Mion, Zinn, Macpeak & Seas, PLLC

[57] ABSTRACT

A vehicular lamp which includes a lamp body having a front opening, a lens coupled to the front opening of the lamp body, a light source disposed within a lamp chamber defined by the lamp body and the lens, and convex and concave fish-eye lens steps arranged in a line direction thereof, wherein because step portions are formed at a boundary of the convex and concave lens steps and the convex lens steps and the concave lens steps are arranged to shift by half a pitch in a column direction thereof, optical images created by the convex and concave lens steps are focused on different points from each other in the front-rear direction of the lens or the lamp, to create an impression of the deep, three dimensional lamp inside.

12 Claims, 7 Drawing Sheets

LENS STRUCTURE FOR LAMPS

BACKGROUND OF THE INVENTION

1. Field of the Invention

The present invention relates generally to a lens structure for lamps, and more particularly to a vehicular lamp a lens of which is formed with fish-eye lens steps, and the lens and the lamp is improved in an external appearance.

Generally an automotive rear combination lamp is formed on a lens with various kinds and types of lens steps for diffusing light beams emitted from a light bulb disposed within the lamp. In addition to the lens steps, retroreflective lens steps (hereinafter referred to RR steps) are also formed on a part of the lens in order to reflect light beams emitted from following automobiles. There has been conventionally proposed various types of the RR steps. For example, fish-eye steps constituted by a part of spherical surface or almost spherical curved surface, or cylindrical steps constituted by a part of cylindrical surfaces.

In any cases, because these lens steps functions not only to diffuse light beams emitting from the light bulb disposed within the lamp but also to reflect parts of external light beams, they importantly contribute to the impression of the lamp viewed from the outside when the lamp is turned on or off, that is, the external appearance of the lamp. In order to improve external appearance of the lamp, various kinds and types in size, configuration, arrangement and the like of these lens steps have been reviewed to design unique external appearances.

Even though the various designs have been considered, however, external appearance could have been hardly improved sufficiently because the functional aspect has a priority to diffuse light beams emitted from the light bulb disposed within lamps to have desired level and the external appearance of the lens steps and lamps is less important.

In view of the foregoing circumstances, one design has been proposed in which the lens steps formed on a lens are constituted by alternately arranging convex fish-eye lens steps and concave fish-eye lens steps by the same pitch, as shown in FIG. 9B. FIG. 9A is a front view of the proposed lens steps; FIG. 9B is a sectional view of the proposed lens steps cut along a line E—E in FIG. 9A, FIG. 9C is an enlarged perspective view of the proposed lens steps shown in FIG. 9A, and FIG. 9D is a longitudinal sectional view of the proposed lens steps at a boundary of the convex fish-eye lens steps and the concave fish-eye lens steps. By arranging in a matrix the convex fish-eye lens steps 11 and the concave fish-eye lens steps 12 both are rectangular in cross section as shown in FIG. 9A, the lens, 5A as a whole can create the desired reflection characteristics for diffusing light beams by means of the difference in refraction of the convex and the concave lens steps. With the lens steps thus designed, which generates the glittering of the lens, the external appearance may be improved viewing from the outside thereof.

However, though the design of the lens steps as shown in FIG. 9A–D may be improved in external appearance, step portions 17 at a boundary of the two different lens steps, which may cause a difficulty during a mold process, of the lens. Specifically, as shown in FIG. 9C and 9D, at the boundary 20 of the convex lens steps 11 and the concave lens steps 12, a height H from the thinnest section of the convex fish-eye lens steps 11 and the thickest section of the concave fish-eye lens steps 12 must be created. Because the height H obstructs the flow of molten resin into tip ends of the concave fish-eye steps 12 while injection molding the lens 5A, sufficient resin pressure at the boundary is not obtained and, as a result, undesirable so-called shrinkage or white line phenomenon may occur. Accordingly, since the lens step configuration is irregular at areas of the shrinkage or white line, the refraction condition of the light beams is deteriorated and, consequently the improvement of the external appearance as desired may not be accomplished.

SUMMARY OF THE INVENTION

The present invention was made in view of the foregoing difficulties and problems accompanying the conventional and proposed lens steps. Therefore, an object of the present invention is to provide a vehicular lamp formed with lens steps capable of extremely improving external appearance of the lamp without suffering from any difficulty during molding process of the lens.

The above and other objects can be accomplished by a provision of a vehicular lamp which, according to the present invention, includes a lamp body having a front opening, a lens coupled to the front opening of the lamp body, a light source disposed within a lamp chamber defined by the lamp body and the lens, and convex and concave fish-eye lens steps arranged in a line direction thereof, wherein step portions formed at a boundary of the convex and concave lens steps, and the convex lens steps and the concave lens steps are arranged to shift by half a pitch in a column direction thereof.

The convex and concave lens steps may preferably be arranged in such a manner that each of the steps is arranged as a line in horizontal direction and alternately in vertical direction.

According to the present invention, since the convex fish-eye lens steps and the concave fish-eye lens steps are arranged alternately in the line direction thereof, optical images created by the convex and concave lens steps are focused on different points from each other in the front and rear of the lens or the lamp, to create an impression of the deep, three dimensional lamp inside. Therefore, the external appearance can be improved. Additionally, because the step portions are formed at the boundary of the convex and concave lens steps, the boundary is enhanced as an accent, which also contributes to the improvement of the external appearance of the lamp. Further, since the convex lens steps and the concave lens steps are arranged to shift by half a pitch in a column direction thereof, the difference in height between the thinnest section of the convex fish-eye lens steps and the thickest section of the concave fish-eye lens steps can be reduced. Owing to the last arrangement, the difficulty during the mold process of the lens can be effectively suppressed.

DESCRIPTION OF THE PREFERRED EMBODIMENTS

The preferred embodiments of the present invention will now be described with reference to accompanying drawings. In the embodiments, the invention is applied to a tail-and-stop lamp installed at a right-rear corner of an automobile body, as one example of rear combination lamps for an automobile.

Figure 1:
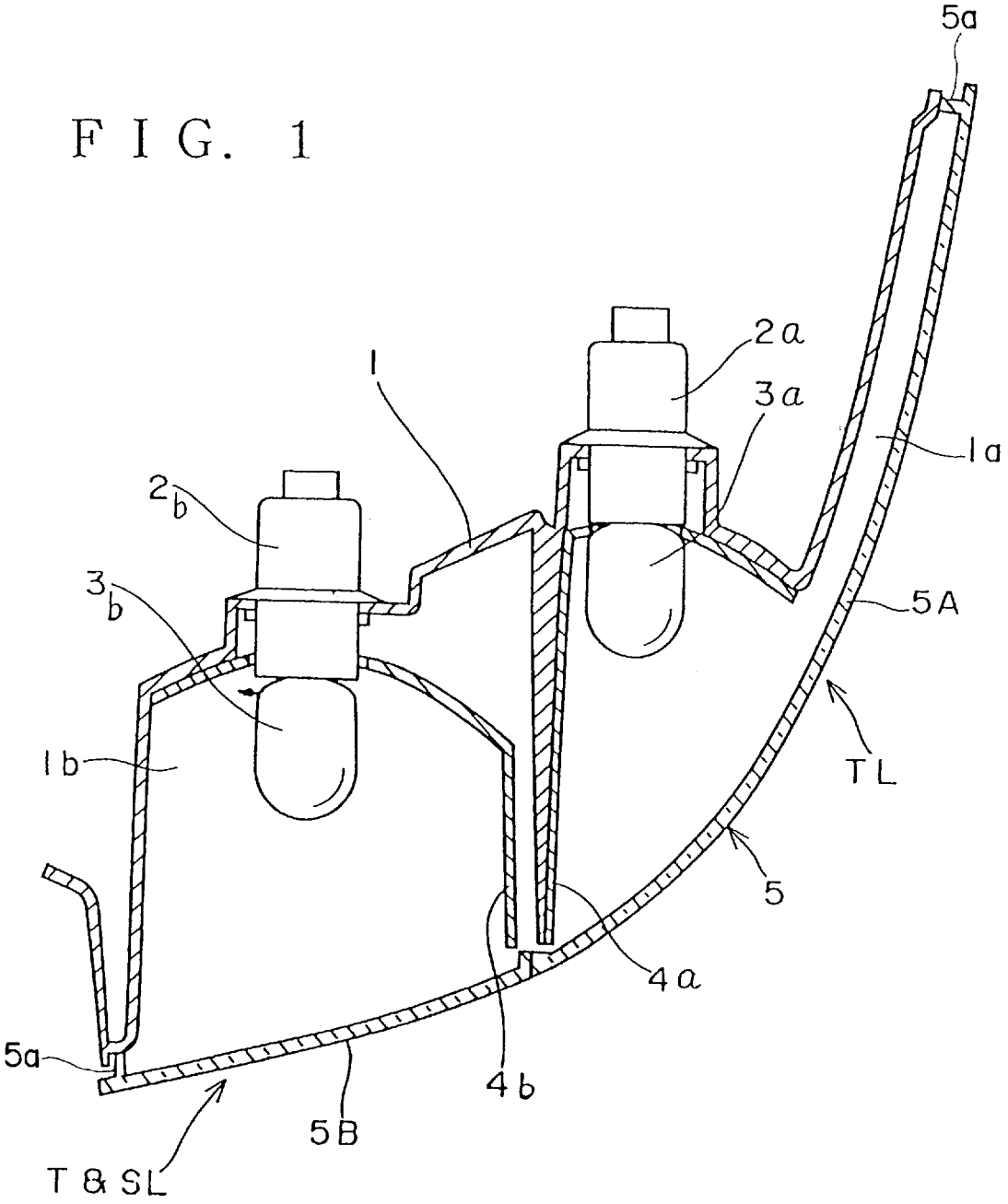
FIG. 1 is an enlarged sectional view showing a vehicular lamp according to one embodiment of the present invention cut along a line A—A in FIG. 3.
Figure 2:
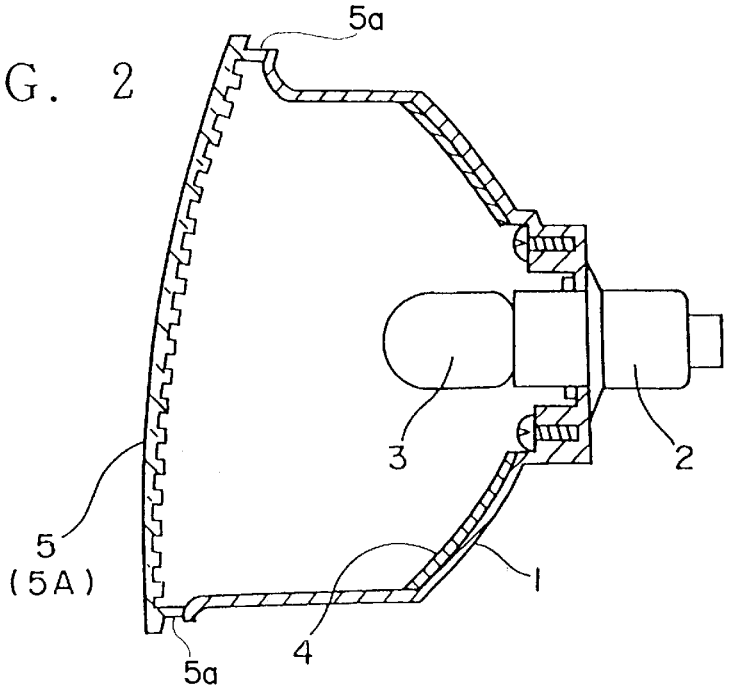
FIG. 2 is an enlarged sectional view showing the vehicular lamp of the invention cut along a line B—B in FIG. 3.
Figure 3:
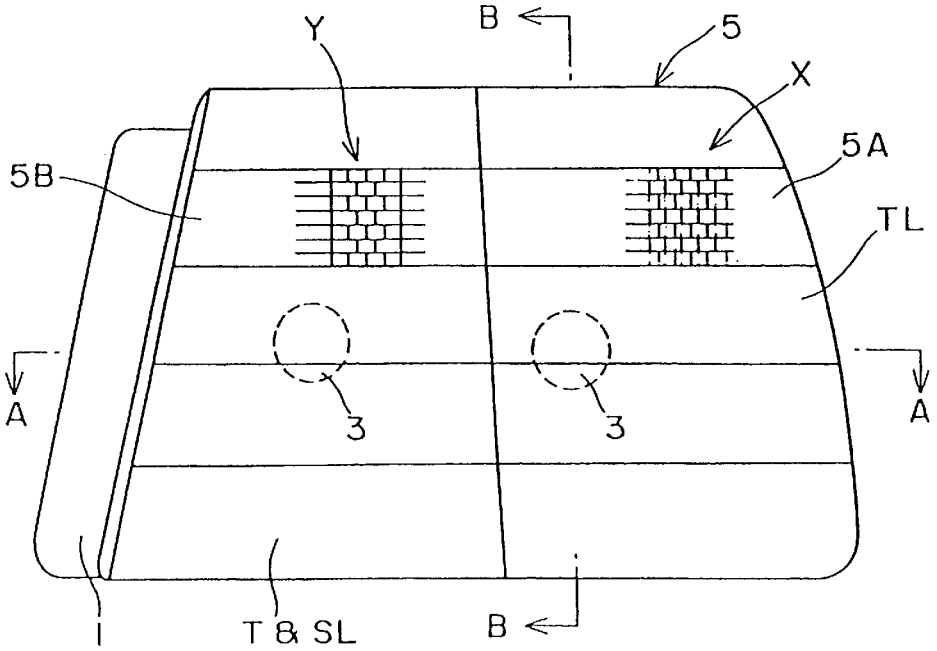
FIG. 3 is a front view showing the vehicular lamp according to the present invention.

FIG. 3 is a front view showing the vehicular lamp according to the present invention, FIG. 1 is an enlarged sectional view showing a vehicular lamp according to one embodiment of the present invention cut along a line A—A in FIG. 3, and FIG. 2 is an enlarged sectional view showing the vehicular lamp of the invention cut along a line B—B in FIG. 3.

As shown in the figures, a lamp body 1 formed to surround from the right-rear part to the side part of the automobile body is divided into two lamp chambers, that is, a lamp chamber 1*a* for a turn-signal lamp TL and a lamp chamber 1*b* for a tail-and-stop lamp T&SL. Light bulbs 3*a* and 3*b* are mounted on sockets 2*a* and 2*b* to locate within the lamp chambers 1*a* and 1*b,* respectively. Inner surfaces of the lamp body 1 in the lamp chambers 1*a* and 1*b* constitute as a reflector by means of aluminum coating or the like. In the embodiment, reflectors 4*a* and 4*b* formed of metal are provided separately from the lamp body 1 in order to increase light intensity directing rearward of the automobile. The reflectors 4*a, 4*b* serve also to improve the heat resistivity of the lamp body 1 not only to reflect the light.

A two-color lens 5 molded by resin is coupled to a front opening of the lamp body 1. The lens 5 is formed with a rib 5*a* projecting from an inner peripheral edge thereof, and a tip end part of the rib 5*a* is fuse-bonded to a peripheral edge of the lamp body 1 so that the lens 5 is integrally coupled to the lamp body 1. According to the embodiment, the lens 5 is constituted by two lens portions, a first amber lens portion 5A for the turn-signal lamp TL and a second red lens portion 5B for the tail-and-stop lamp T&SL, which are integrally formed with each other by means of, for example, a multi-color molding process.

As shown in FIG. 3, the lens 5 (5A and 5B) is provided with a plurality of lens steps and RR lens steps on an inner surface thereof, and steps extending laterally are formed on a plurality of sections on the inner surface of the lens 5, to create an external appearance having thick lateral stripes. In the embodiment shown in FIG. 3, the lens 5A for the turn-signal lamp TL is formed with only the lens steps whereas the lens 5B for the tail-and-stop lamp T&SL is formed with mixture of both the lens steps and the RR steps.

Figure 4A:
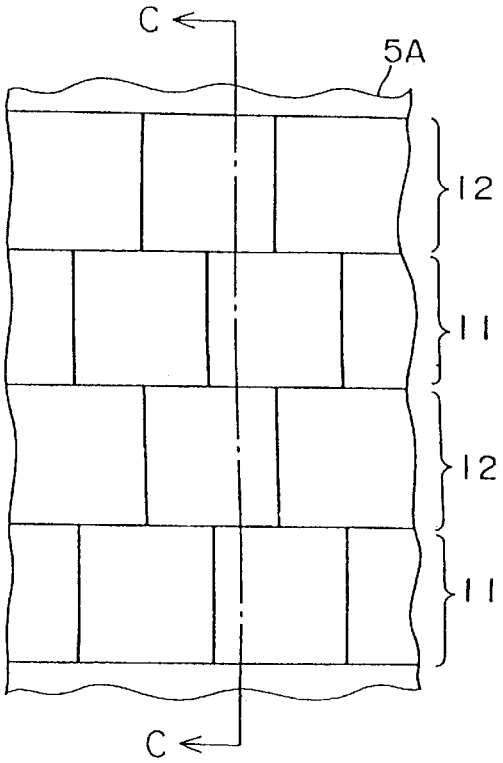
FIG. 4A is an enlarged front view of lens steps at an X section of FIG. 3.
Figure 4B:
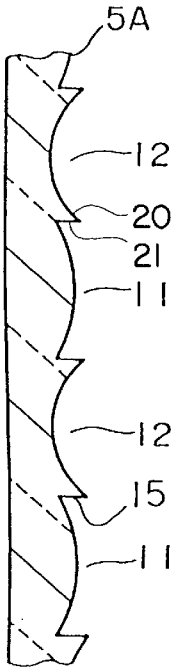
FIG. 4B is a sectional view showing the lens steps cut along a line C—C in FIG. 4A.
Figure 4D:
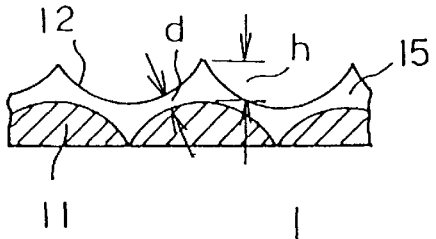
FIG. 4D is a vertical sectional view of the lens steps at a boundary thereof.
Figure 4C:
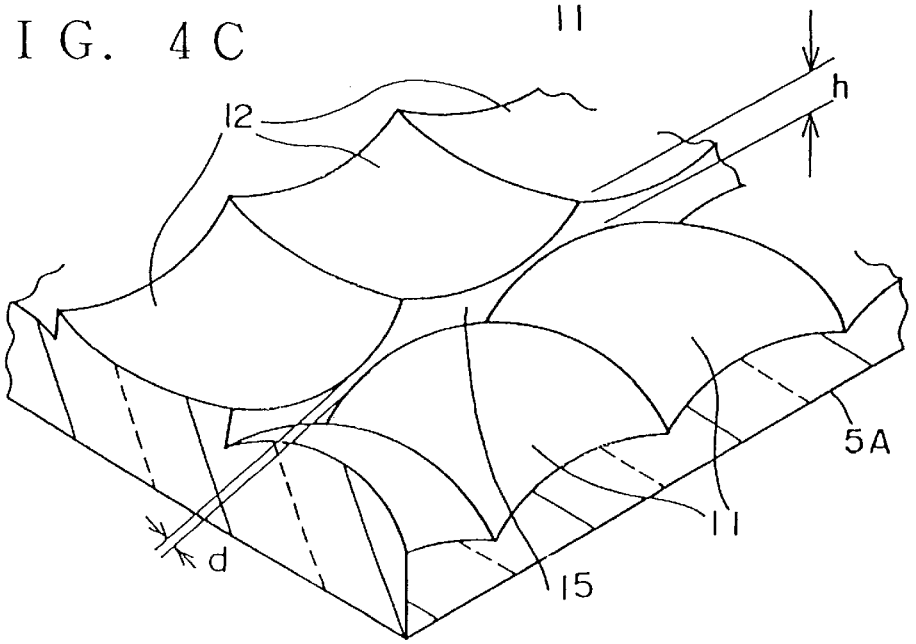
FIG. 4C is an enlarged perspective view of the lens steps shown in FIG. 4A.

FIG. 4A is an enlarged front view of lens steps at an X section of FIG. 3, FIG. 4B is a sectional view showing the lens steps cut along a line C—C in FIG. 4A, FIG. 4C is an enlarged perspective view of the lens steps shown in FIG. 4A, and FIG. 4D is a vertical sectional view of the lens steps at a boundary thereof. As shown in FIG. 4A–D, the lens steps 4 each consists of a convex fish-eye steps 11 which is regular square and constituted by a convex-spherical or almost convex-spherically curved inner surface and a concave fish-eye steps 12 constituted by a concave-spherical or almost concave-spherically curved inner surface. According to the embodiment, each of the steps 11 and 12 is laterally arrayed in a single line on the lens 5A, and the convex fish-eye steps 11 and the concave fish-eye steps 12 are alternately arranged in the vertical direction.

Further, a lens surface of the concave fish-eye lens steps 12 is designed to be higher than a lens surface of the convex fish-eye lens steps 11 at the junction of the concave fish-eye lens steps 12 and the convex fish-eye lens steps 11 in the line direction thereof to define a step portion 15 having a height d shown in FIGS. 4C and 4D. Owing to the step portion 15, a continuous line is created throughout the plurality of the junction of the concave fish-eye lens steps 12 and the convex fish-eye lens steps 11.

In addition, according to the embodiment, the concave fish-eye lens steps 12 and the convex fish-eye lens steps 11 are arranged in such a manner that the both have the same pitch dimension but are shifted by half a pitch thereof in the column direction thereof as best shown in FIG. 4A. Furthermore, a thickness of each of the concave fish-eye lens steps 12 is substantially the same as that of the convex fish-eye lens, steps 11. As a result, an edge 20 of each concave fish-eye lens step 12 projects away from the edge 21 of adjacent convex fish-eye lens steps 11 as shown in FIG. 4B.

Figure 5A:
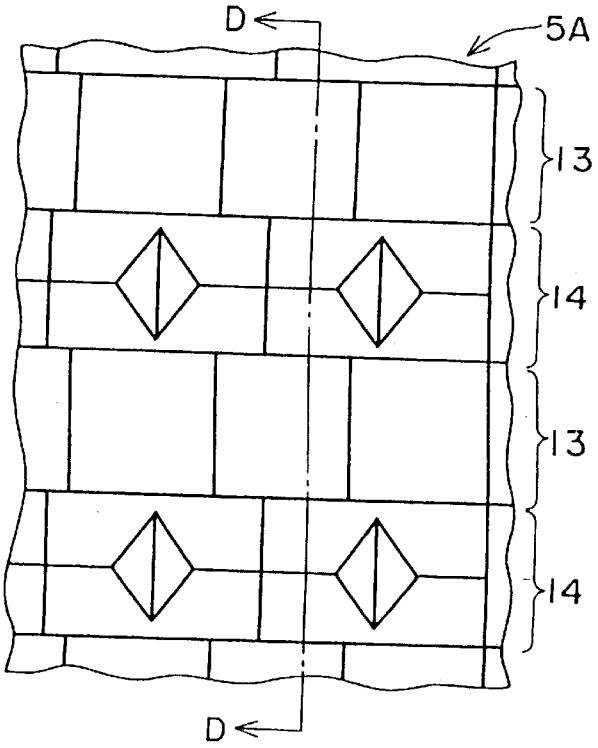
FIG. 5A is an enlarged front view of lens steps at a Y section of FIG. 3.
Figure 5B:
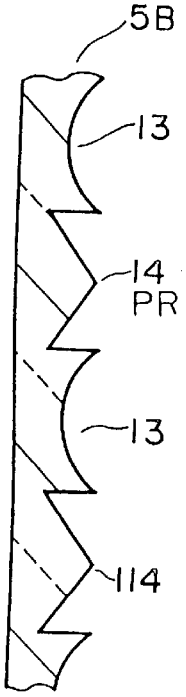
FIG. 5B is a sectional view showing the lens steps cut along a line D—D in FIG. 5A.
Figure 5C:
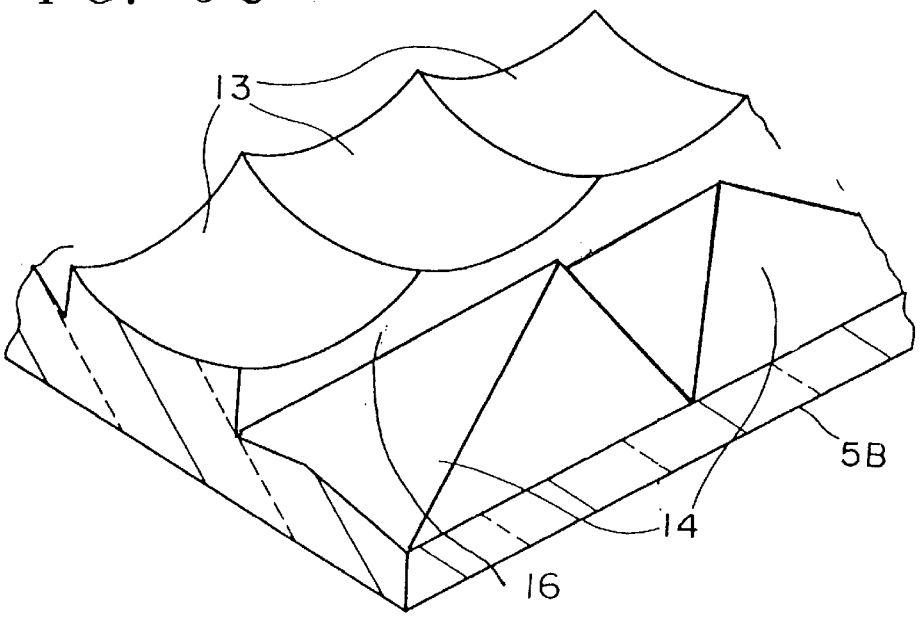
FIG. 5C is an enlarged sectional view of the lens steps shown in FIG. 5A.
Figure 6A:
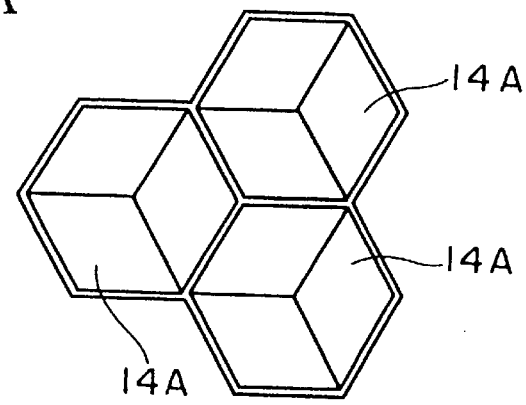
FIGS. 6A, 6B, 6C and 6D are explanatory views showing effective lens steps.
Figure 6B:
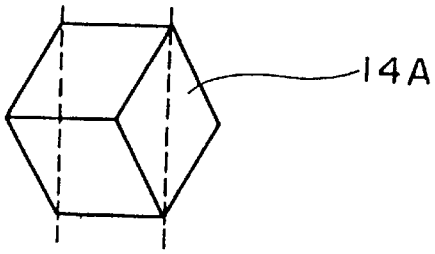

On the other hand, the lens 5B for the tail-and-stop lamp T&SL will be described with reference to FIGS. 5A–5C. Specifically, FIG. 5A is an enlarged front view of lens steps at a Y section of FIG. 3, FIG. 5B is a sectional view showing the lens steps cut along a line D—D in FIG. 5A, and FIG. 5C is an enlarged sectional view of the lens steps shown in FIG. 5A. The lens 5B for the tail-and-stop lamp T&SL is constituted by lens steps 13 and retroreflective (RR) steps 14. The lens steps 13, which have the same design as the concave fish-eye steps 12, are laterally arrayed in the column direction. The RR steps 14 are formed by individual RR step elements 14A which are constituted by arranging a plurality of trigonal pyramids as shown in FIG. 6A. The front view of the RR step element 14 is generally designed to be regular hexagonal. In the embodiment, however, both corner parts of the individual RR step element 14A are cut off to be rectangular in front view as shown in FIG. 6B.

Figure 6C:
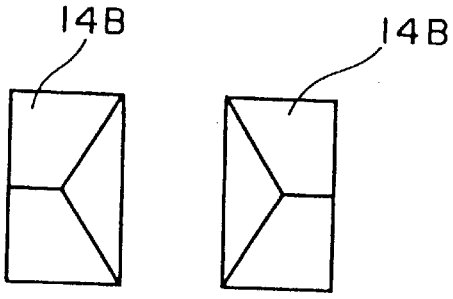
Figure 6D:
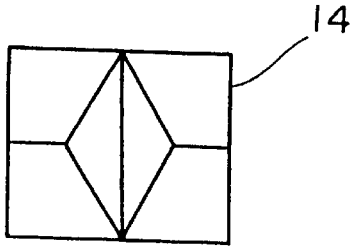

A couple of individual RR step elements 14A are arranged in the column direction to face each other to be essentially regular square in front view as shown in FIGS. 6C and 6D. According to the embodiment, a ratio of vertical length and horizontal length of the RR step 14 is designed to be $\sqrt{3}:1$ and, consequently, the pitch of the lens steps 13 is different in the column direction from that of the RR steps 14.

Each of the concave fish-eye steps 13 and the RR steps 14 are arrayed in the horizontal direction at interval in the vertical direction. In this case, the pitch dimension of the RR steps 14 is larger than that of the concave fish-eye lens steps 13 as described above and, therefore, the pitches of the RR steps 14 and the concave fish-eye lens steps 13 are shifted from each other. For this reason, even if a step portion 16 is defined between both steps as shown in FIG. 5C, the largest dimension of the height of the step portion 16 can be suppressed.

The lens 5A of the turn-signal lamp TL and the lens 5E of the tail-and-stop lamp T&SL are so arranged that both the concave fish-eye steps 12 and 13 are aligned in the vertical direction to form single horizontal lines. Accordingly, the convex fish-eye steps 11 of the lens 5A of the turn-signal lamp TL and the RR steps 14 of the lens 5B of the tail-and-stop lamp T&SL are located on the same horizontal lines. Thus, the concave fish-eye steps 12 and 13 constitute a continuous step structure in the horizontal direction extending over both the lenses 5A and 5B, so that the lenses 5A and 5B creates an external appearance looking like a single unit.

Figure 7A:
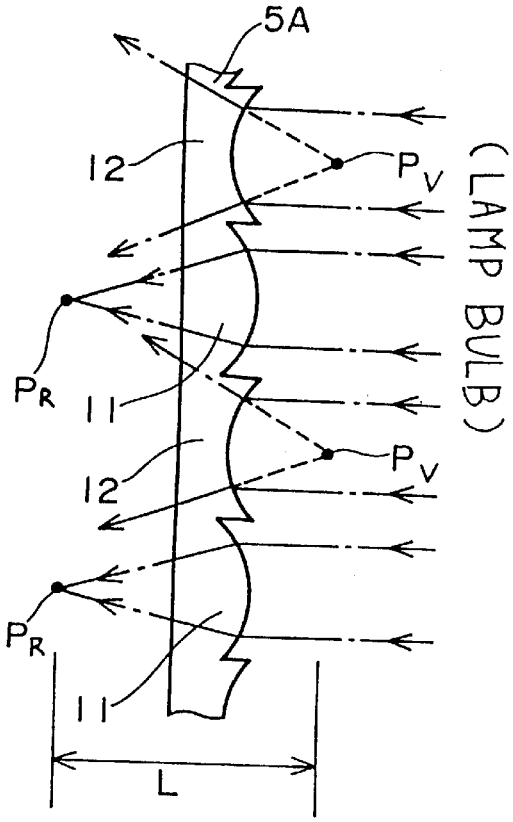
FIGS. 7A and 7B show optical condition contributing to external appearance of the lamp.

According to the rear combination lamp having the lenses designed as described above, the lens 5A of the turn-signal lamp TL is formed with the convex fish-eye steps 11 and the concave fish-eye steps 12 which are arranged at interval in the vertical direction. Therefore, as shown by optical locus in FIG. 7A, light emitting from the light bulb is focused by the convex fish-eye steps 11 to form a real image at a point $P_R$ in front (outside) of the lens 5A on one hand whereas it is focused by the concave fish-eye steps 12 to form a virtual image at a point $P_V$ behind (inside) the lens 5A on the other hand. These real images and the virtual images are formed at interval in the vertical direction by fine dimensions and, therefore, the real images and the virtual images are focused on the different points $P_R$ and $P_V$ having a distance in the front-rear direction of the lens, to thereby create an impression of the deep, three dimensional lamp inside having a depth L, when viewing the lens from the outside. In addition, since a number of these brilliant points $P_R$ and $P_V$ cooperatively generate a glittering of the lens, a high grade external appearance of the lens can be accomplished.

Further, since the brilliant points $P_R$ are distant from the brilliant points $P_V$ in the front-rear direction of the lamp owing to the convex fish-eye steps 11 and the concave fish-eye steps 12, the deep impression is enhanced when the lens 5A is viewed from angled position or from roughly side position. The high-grade impression of the lens 5A is much more improved when the automobile is driving because the brilliant points $P_R$ and $P_V$ are also moving together.

Figure 7B:
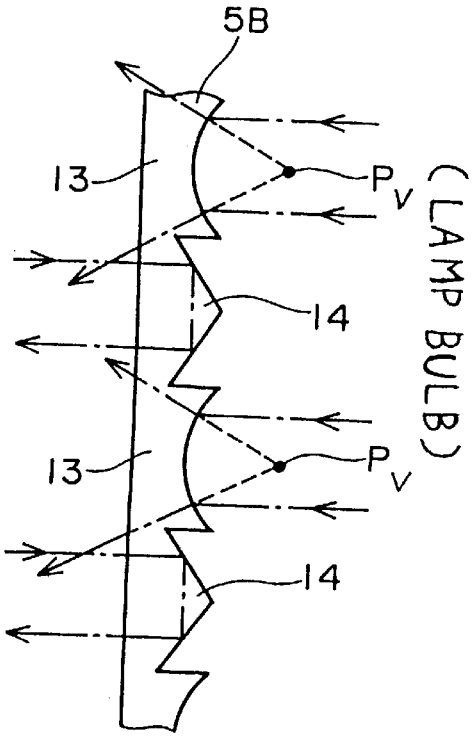

On the other hand, with the lens 5B for the tail-and-stop lamp T&SL as shown by optical locus in FIG. 7B, light emitting from the light bulb is focused by the concave fish-eye steps 13 to form a virtual image at a brilliant point $P_V$ behind (inside) the lens 5B whereas incident light to the RR steps 14 from the outside is reflected back in parallel though light emitting from the light bulb of the lamp does not pass through the RR steps 14. Therefore, the deep impression can be attained by the brilliant points $P_V$ created by the concave fish-eye steps 13 and the reflective light of the RR steps 14, and the high-grade impression of the lens and the lamp can be realized.

Because both the concave fish-eye steps 12 of the lens, 5A and the concave fish-eye steps 13 of the lens 5B are aligned in the vertical direction to form single horizontal lines, the brilliant points $P_V$ are generated in the lateral direction continuously throughout the lenses 5A and 5B, so that the lenses 5A and 5B creates an external appearance looking like a single unit, though the lenses 5A and 5B have the different: lens steps.

With respect to the lens 5A of the turn-signal lamp TL, owing to the step portion 15 defined at the junction of the concave fish-eye lens steps 12 and the convex fish-eye lens steps 11 in the line direction thereof, a continuous line is created throughout the plurality of the junction of the concave fish-eye lens steps 12 and the convex fish-eye lens steps 11 while appearing the definite boundary between these two different lens steps. Because of this feature, the boundary of the two lenses is enhanced as an accent, which also contributes to the improvement of the external appearance of the lens 5A. On the other hand, with respect also to the lens 5B, the step portion 16 extending continuously in the horizontal direction of the lens is defined between the RR steps 14 and the concave fish-eye lens steps 13. Accordingly, the external appearance throughout the lens 5.

Moreover, because the concave fish-eye lens steps 12 and the convex fish-eye lens steps 11 are arranged in such a manner that the both have the same pitch dimension but are shifted by half a pitch thereof in the column direction thereof, the brilliant points $P_R$ created by the lens steps 11 and that $P_V$ created by the lens steps 12 are also shifted by half a pitch in the column direction. These different brilliant points $P_R$ and $P_V$ cause fine and complicated matrixes which further enhance the high-grade impression of the lamp.

Figure 8:
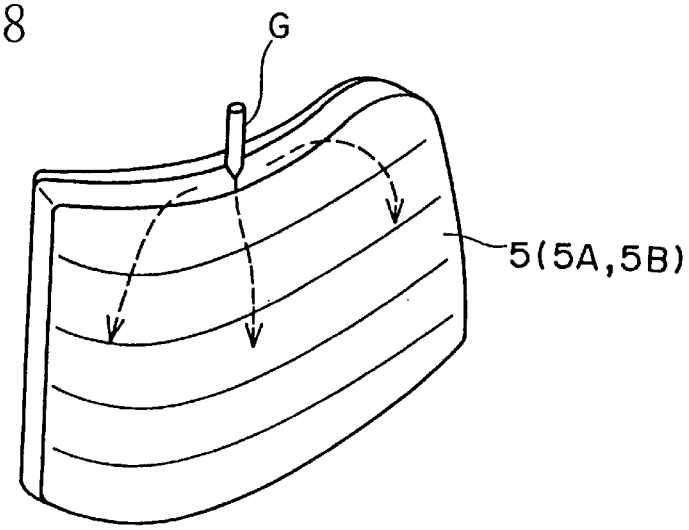
FIG. 8 is a schematic view showing resin flow during molding process.

From a viewpoint of the lens molding process, as briefly shown in FIG. 8, molten resin is injected through a plurality of gates G (only one gate is shown in FIG. 8) for a mold die as indicated by dotted arrows. Since the concave fish-eye lens steps 12 and the convex fish-eye lens steps 11 are shifted by half a pitch thereof in the column direction as shown in FIG. 4, the height h of the step 15, shown in FIGS. 4C and 4D, at the edge parts of both the steps can be minimized, so that smooth resin flow can be realized during the resin molding process. Consequently, the problem of undesirable shrinkage of the lens or the white line phenomenon can be suppressed.

Figure 9A:
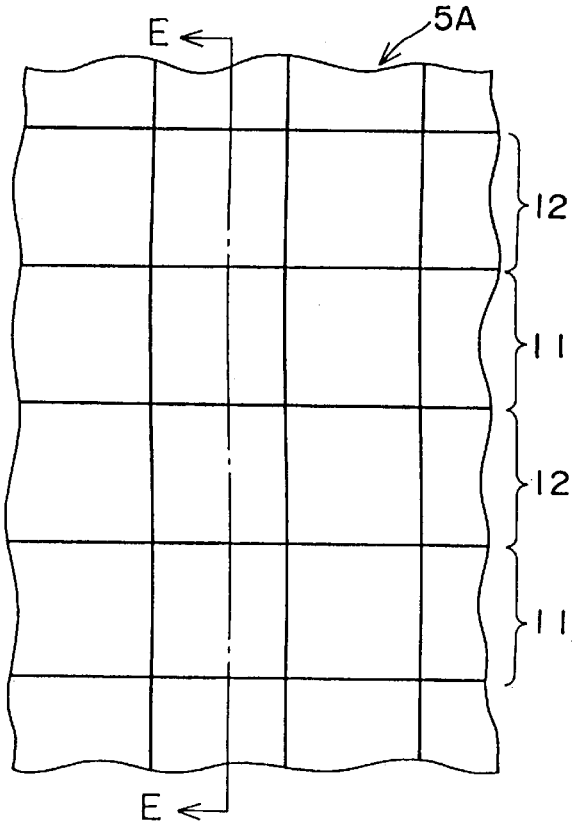
FIG. 9A is a front view of proposed lens steps.
Figure 9B:
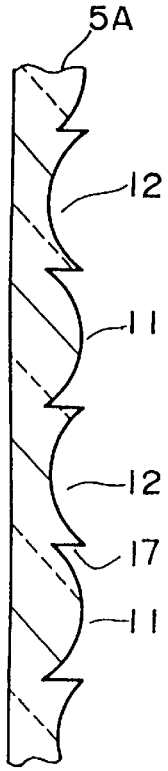
FIG. 9B is a sectional view of the proposed lens steps cut along a line E—E in FIG. 9A.
Figure 9D:
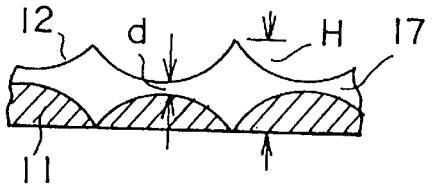
FIG. 9D is a longitudinal sectional view of the proposed lens steps at a boundary of convex fish-eye lens steps and concave fish-eye lens steps.
Figure 9C:
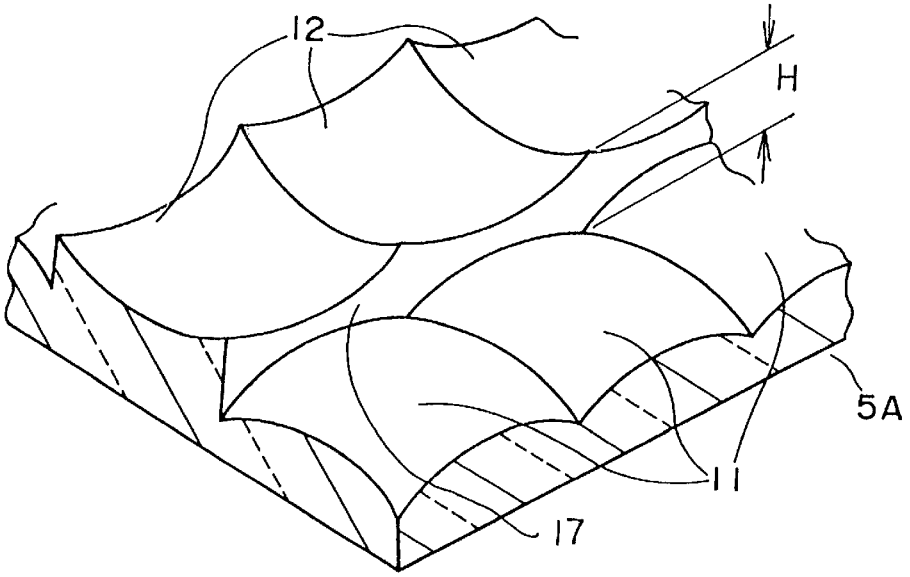
FIG. 9C is an enlarged perspective view of the proposed lens steps shown in FIG. 9A.

In particular, as described above, in a case where the step portion 15 is defined at the junction between the convex fish-eye steps 11 and the concave fish-eye steps 12, as shown in FIGS. 9C and 9D, the distance H, i.e., the height difference between the steps 11 and 12, is enlarged corresponding to the height of the step portion 15 when desired dimension of the step portion is required. In this regards, according to the present invention, since both the steps are shifted by half a pitch, such an enlargement of the height difference can be minimized even if the step portion 15 is formed, which also contributes to suppress the difficulty during the resin molding process.

Although the present invention is applied to an automotive turn-signal lamp and tail-and-stop lamp in the foregoing description, it is not limited thereto or thereby. That is, the lens step structure of the present invention may also be applied to the other automotive lamp such as a tail lamp or a lamp for a garnish or the like to improve the external appearance.

As described above, according to the present invention, a lamp in which convex and concave fish-eye lens steps are arranged in a line direction thereof, wherein step portions formed at a boundary of the convex and concave lens steps, and the convex lens steps and the concave lens steps are arranged to shift by half a pitch in a column direction thereof. Accordingly, optical images created by the convex and concave lens steps are focused on different points from each other in the front-rear direction of the lens or the lamp, to thereby create an impression of the deep, three dimensional lamp inside. Therefore, the external appearance can be improved.

Further, because step portions are formed at the boundary of the convex and concave lens steps, the boundary of the two is enhanced as an accent, which also contributes to the improvement of the external appearance of the lamp.

Furthermore, since the convex lens steps and the concave lens steps are arranged to shift by half a pitch in a column direction thereof, the difference in height between the thinnest section of the convex fish-eye lens steps and the thickest section of the concave fish-eye lens steps can be reduced. Owing to the last arrangement, smooth resin flow can be realized during the resin molding process of the lamp, and the difficulty during the mold process of the lens can be effectively suppressed.

It should be understood that the form of the invention herein shown and described is to be taken as a preferred example of the invention and that various changes in the shape, size and arrangement of parts may be resorted to without departing from the spirit of the invention or the scope of the subjoined claims.

What is claimed is:

1. An automotive lamp, comprising:

a lamp body having a front opening;

a lens coupled to said front opening of said lamp body;

a light source disposed within a lamp chamber defined by said lamp body and said lens; and a plurality of first lens steps and a plurality of second lens steps formed on said lens, said plurality of first lens steps and said second plurality of second lens steps arranged in a first row of first lens steps and a second row of second lens steps, said first row adjacent to said second row in a horizontal direction thereof, each of said first lens steps being shifted from each adjacent one of said second lens steps by half a pitch in a vertical direction, wherein said first lens steps comprise concave fish-eye lens steps and said second lens steps comprise convex fish-eye lens steps.

2. The automotive lamp according to claim 1, wherein said adjacent rows of first len steps and second lens steps are arranged alternately in vertical direction of the lamp.

3. The automotive lamp according to claim 1, wherein a pitch of each of said concave fish-eye lens steps and a pitch of each of said convex fish-eye lens steps are substantially equal in the horizontal direction and shifted by half a pitch thereof in the vertical direction.

4. The automotive lamp according to claim 1, wherein thickness of each of said concave fish-eye lens steps is substantially equal to thickness of each of said convex fish-eye lens steps.

5. The automotive lamp according to claim 1, wherein said lens comprises a first lens portion and a second lens portion, said plurality of first lens steps and said plurality of second lens steps formed on said first lens portion and said second lens portion respectively, said first row of said first lens portion and said second row of said second lens portion aligned to form a single horizontal row across an intersection between said first lens portion and said second lens portion.

6. The automotive lamp according to claim 1, wherein light emitting from said light source is focused by said convex fish-eye lens steps to form a plurality of real images in front of said lens, and light emitting from said light source is focused by said concave fish-eye lens steps to form a plurality of virtual images behind said lens.

7. The automotive lamp according to claim 5, wherein the lamp is a rear combination lamp and said first lens portion is a turn-signal lamp and said second lens portion is a tail-and-stop lamp.

8. A lens structure, comprising:

a receptacle having an opening;

a lens coupled to said opening of said receptacle;

a light source disposed within a chamber defined by said receptacle and said lens a plurality of first lens steps and a plurality of second lens steps formed on said lens, said plurality of first lens steps and said plurality of second lens steps arranged in a first row of first lens steps and a second row of second lens steps, said first row adjacent to said second row in a horizontal direction thereof, each of said first lens steps being shifted from each adjacent one of said second lens steps by half a pitch in a vertical direction thereof, wherein said first lens steps comprise concave fish-eye lens steps and said second lens steps comprise convex fish-eye lens steps.

9. The lens structure according to claim 8, wherein said adjacent rows of first lens steps and second lens steps are arranged alternately in vertical direction of the lamp.

10. The lens structure according to claim 8, wherein a pitch of each of said concave fish-eye lens steps and a pitch of each of said convex fish-eye lens steps are substantially equal in the horizontal direction and shifted by half a pitch thereof in the vertical direction.

11. The lens structure according to claim 8, wherein thickness of each of said concave fish-eye lens steps is substantially equal to thickness of each of said convex fish-eye lens steps.

12. The lens structure according to claim 8, wherein said lens comprises a first lens portion and a second lens portion, said plurality of first lens steps and said plurality of second lens steps formed on each of said first lens portion and said second lens portion, said first lens steps of said first lens portion and said second lens steps of said second lens portion aligned in the vertical direction to form single horizontal rows across an intersection between said first lens portion and said second lens portion.

* * * * *